United States Patent [19]

Mori

[11] 4,406,537

[45] Sep. 27, 1983

[54] REPRODUCTION SYSTEM WITH A VARIABLE MAGNIFYING FUNCTION

[75] Inventor: Goro Mori, Tokyo, Japan

[73] Assignee: Ricoh Company, Ltd., Japan

[21] Appl. No.: 249,063

[22] Filed: Mar. 30, 1981

[30] Foreign Application Priority Data

Apr. 7, 1980 [JP] Japan ..... 55-46585[U]

[51] Int. Cl.[3] ..... G03G 15/14; G03G 15/22

[52] U.S. Cl. ..... 355/14 SH; 271/9; 271/145; 355/3 SH

[58] Field of Search ..... 355/3 R, 3 SH, 14 SH; 271/9, 145

[56] References Cited

U.S. PATENT DOCUMENTS 4,190,246 2/1980 Sasuga ..... 355/3 SH X 4,302,098 11/1981 Kan et al. ..... 355/3 SH X

FOREIGN PATENT DOCUMENTS 53-47803 3/1978 Japan ..... 355/14 SH

*Primary Examiner*—Fred L. Braun

*Attorney, Agent, or Firm*—Guy W. Shoup; Gerard F. Dunne

[57] ABSTRACT

A system for determining the existence of a selected size and orientation of copy papers to be used in a copying machine is provided. Such a system is particularly useful when applied to a copying machine for making copies from an original with various magnification ratios. The system has a size indicator as well as an orientation indicator so that when installed copy papers do not satisfy the condition required by a desired mode of copying operation, it will be clearly indicated whether the size and/or the orientation of the installed copy papers are inappropriate. Thus, convenience in using a copying machine has been greatly improved.

17 Claims, 10 Drawing Figures

FIG. 5

| COPY PAPER | $b_7$ | $b_6$ | $b_5$ | $b_4$ | $b_3$ | $b_2$ | $b_1$ | $b_0$ | CODE DESIGNATION |
|---|---|---|---|---|---|---|---|---|---|
| A 4 "P" | 0 | 0 | 0 | 1 | 0 | 1 | 0 | 0 | 14H |
| B 4 "P" | 0 | 0 | 0 | 0 | 0 | 1 | 0 | 0 | 04H |
| B 5 "P" | 0 | 0 | 0 | 0 | 0 | 1 | 0 | 1 | 05H |
| A 3 "∇" | 0 | 0 | 1 | 1 | 0 | 0 | 1 | 1 | 33H |
| A 4 "∇" | 0 | 0 | 1 | 1 | 0 | 1 | 0 | 0 | 34H |
| B 4 "∇" | 0 | 0 | 1 | 0 | 0 | 1 | 0 | 0 | 24H |
| A 5 "∇" | 0 | 0 | 1 | 1 | 0 | 1 | 0 | 1 | 35H |

SIZE

SIZE A or B (1:A, 0:B)

ORIENTATION (1:"∇", 0:"P")

FIG. 6

| SELECTION SWITCH | $b_7$ | $b_6$ | $b_5$ | $b_4$ | $b_3$ | $b_2$ | $b_1$ | $b_0$ | CODE DESIGNATION |
|---|---|---|---|---|---|---|---|---|---|
| A3 → A4 "∇" | 0 | 0 | 1 | 1 | 0 | 1 | 0 | 0 | 34H |
| A3 → B4 "∇" | 0 | 0 | 1 | 0 | 0 | 1 | 0 | 0 | 24H |
| B4 → B5 "P" | 0 | 0 | 0 | 0 | 0 | 1 | 0 | 1 | 05H |
| A4 → B5 "P" | 0 | 0 | 0 | 0 | 0 | 1 | 0 | 1 | 05H |
| B4 → A4 "P" | 0 | 0 | 0 | 1 | 0 | 1 | 0 | 0 | 14H |

SIZE

SIZE A or B (1:A, 0:B)

ORIENTATION(1:"∇", 0:"P")

FIG. 7

| | $b_7$ | $b_6$ | $b_5$ | $b_4$ | $b_3$ | $b_2$ | $b_1$ | $b_0$ |
|---|---|---|---|---|---|---|---|---|
| MAGAZINE 10(A4 "∇") | 0 | 0 | 1 | 1 | 0 | 1 | 0 | 0 |
| SELECTION SWITCH (B4 "∇") | 0 | 0 | 1 | 0 | 0 | 1 | 0 | 0 |

| | $b_7$ | $b_6$ | $b_5$ | $b_4$ | $b_3$ | $b_2$ | $b_1$ | $b_0$ |
|---|---|---|---|---|---|---|---|---|
| MAGAZINE 11 (B5 "P") | 0 | 0 | 0 | 0 | 0 | 1 | 0 | 1 |
| SELECTION SWITCH 16 (B4 "∇") | 0 | 0 | 1 | 0 | 0 | 1 | 0 | 0 |

REPRODUCTION SYSTEM WITH A VARIABLE MAGNIFYING FUNCTION

BACKGROUND OF THE INVENTION

1. Field of the Invention

This invention generally relates to a system for indicating to an operator whether copy papers installed in a copying machine are appropriate or not. More in particular, the present invention relates to a reproduction system capable of making copies having different sizes, usually in reduced sizes, from that of an original, and which can indicate to an operator whether copy papers installed are inappropriate in orientation and/or size.

2. Description of the Prior Art

A copying machine having a variable magnifying function has been well known. In such a copying machine, the ratio of magnification is usually less than unity, i.e., a reproduced image being smaller than an original image. Some of the copying machines of this type have a plurality of fixed magnification ratios. However, since it is practically impossible to install copy papers having all possible orientations and sizes, it is common practice to provide a few, usually two, detachable magazines in which desired copy papers may be stored. Therefore, it happens that when an operator selects a particular magnification ratio, required copy papers are not installed. In such a case, even if a copy has been made, a reproduced image would be inappropriately located on a copy paper or the original image would be partly lost. Accordingly, it is important to restrain the copying process from proceeding until required copy papers are installed.

One conventional technique to cope with the above-mentioned problem is to provide a warning lamp which simply indicates that required copy papers are not installed prior to the initiation of the copying process. It is true that provision of such a warning lamp can eliminate the possibility of making inappropriate and often times useless copies, but such prior art technique still suffers from various disadvantages. For example, when the warning lamp is lit, the operator knows that the copy papers installed are not approriate; however, he or she does not know immediately what is wrong about the installed copy papers. Thus, the operator has to draw out the magazines and then determine what is wrong about the copy papers stored in the magazines. This is quite inconvenient, and since it relies on the personal judgment rendered by the operator, substituted copy papers could be inappropriate again, which is still more inconvenient.

The disadvantages of the above-mentioned prior art technique mainly stems from the fact that only a single warning lamp is provided. In other words, there are basically two parameters to be taken into account when copies of different sizes are to be reproduced. These parameters are size and orientation of a copy paper. That is, when one wishes to make a copy of a reduced size from an original, it is important that there is installed a copy paper having the corresponding reduced size with a proper orientation. Because, once a particular magnification ratio has been selected, the size and orientation of a copy paper is uniquely determined in accordance with the size and orientation of an original used.

However, since only the condition that the installed copy papers are inappropriate is indicated in accordance with the prior art technique, a heavy burden is still on the operator to check and determine what is wrong; and, therefore, the prior art copying machines were inconvenient to use, and such inconvenience tends to nullify the convenience provided by the magnifying capability in making copies.

SUMMARY OF THE INVENTION

The disadvantages of the prior art are overcome with the present invention and an improved system for determining whether appropriate copy papers are installed in a copying machine or not is provided. The present invention may be advantageously applied to a reproduction system having a variable magnifying function which is capable of making copies of the sizes different from that of an original.

The advantages of the present invention are preferably attained by providing at least two indicators, i.e., a size indicator and an orientation indicator, which are actuated when copy papers installed in a copying machine are not appropriate. The present invention includes a comparing means which is connected between a storing means for storing a quantity of copy papers and the indicators and which is also connected to a selection means. Thus, the comparing means receives and compare signals from the storing means and also from the selection means to produce output signals if desired copy papers selected by said selecting means are not found in said storing means.

Preferably, the comparing means includes a pair of non-coincidence circuits which are connected to the size and orientation indicators, respectively. Each of the non-coincidence circuits is preferably comprised of a logic gate of an exclusive OR circuit. It is preferred to provide a plurality of magazines for storing copy papers of different sizes and/or orientations in order to provide a wide range of size and orientation selections for an operator. The selection means may be in the form of a plurality of selection switches, each of which has a particular designation for size and orientation.

Accordingly, it is an object of the present invention to provide an improved warning system for copy papers installed in a copying machine.

Another object of the present invention is to provide a system for determining whether copy papers installed in a copying machine are appropriate in size and orientation.

A further object of the present invention is to provide a copying machine for making copies from an original with various magnification ratios which is capable of indicating the absence of size and/or orientation of a copy paper selected by an operator.

A still further object of the present invention is to provide a copying machine with a variable magnifying function, which is greatly improved in convenience and easy to use.

Other objects, advantages and novel features of the present invention will become apparent from the following detailed description of the invention when considered in conjunction with the accompanying drawings.

BRIEF DESCRIPTION OF THE DRAWINGS

FIG. 5 is a table showing the relationship between a eight bit code consisting of binary numbers and a particular size and orientation of a copy paper installed in a copying machine;

FIG. 6 is a table showing the relationship between selection switches, each having a particular magnification ratio and orientation designation, and eight bit codes consisting of binary number;

FIG. 7 is a table showing two codes from encoders A1 and C to be compared at the non-coincidence circuits A2 and B2;

DESCRIPTION OF THE PREFERRED EMBODIMENTS

Figure 1:
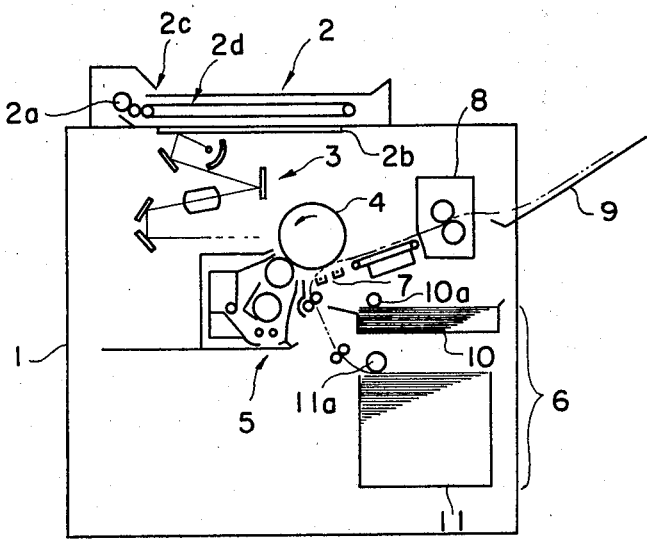
FIG. 1 is a schematic illustration in cross-section of a copying machine to which the present invention is to be embodied.

Referring now to FIG. 1, there is shown a copying machine 1 which includes an original feeding station 2, an exposure-optical system 3, a photosensitive drum 4, a developing station 5, a copy paper feeding station 6, a transfer station 7, a fixing station 8 and a tray 9. Although the machine 1 further includes other components such as a charging device and a cleaning device around the peripheral surface of the drum 4, they are not shown in FIG. 1 for the sake of simplicity.

At the copy paper feeding station 6, there are provided an upper magazine 10 and a lower magazine 11, each storing therein a quantity of copy papers having a particular size and orientation. The magazines 10 and 11 may be detachable or slidably provided in the copying machine 1 so that they can be substituted with other magazines storing copy papers of different sizes and/or orientations. Paper feed rollers 10*a* and 11*a* are disposed at the exit ends of the upper and lower magazines 10 and 11, respectively. When either of the magazines 10 and 11 is selected for operation, the roller 10*a* or 11*a* starts to feed copy papers stored in the related magazine one by one to the transfer station 7, thereby the copy papers are fed and transported in association with the rotation of the photosensitive drum 4. On the peripheral surface of the drum 4 is formed a toner image developed at the developing station 5, which is then transferred to a copy paper fed from the selected magazine at the transfer station 7. Then, the copy paper now bearing thereon a transferred toner image is transported to the fixing station 8 where the transferred toner image is fixed to the copy paper, and, thereafter, the copy paper is discharged out onto the tray 9.

It is to be noted that the original feeding station 2 is pivoted to a shaft 2*a* so that when it is desired to make a copy from a thick original such as a book, the original feeding station 2 may be pivoted around the shaft 2*a* in the counter-clockwise direction to expose a glass plate 2*b* on which the thick original can be placed stationary. Thus, when a copy is to be made from a thick original, at least a part of the exposure-optical system 3 must travel with respect to the stationary original for scanning. On the other hand, if it is desired to make a copy from a sheet type original, it is only necessary to insert the original into the original holding station 2 through a slot 2*c* with the original holding station 2 resting on the glass plate 2*b*. In this mode of operation, since the original is transported through the station 2 by a transporting mechanism 2*d*, the exposure-optical system 3 maybe held stationary.

Figure 2:
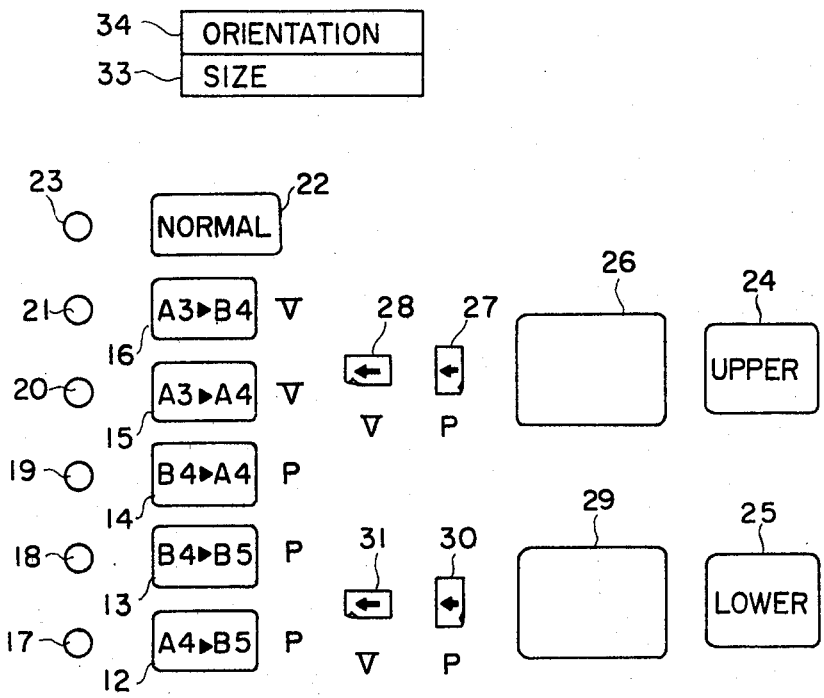
FIG. 2 shows the arrangement of indicator plates, displayes and several switches of a control panel forming a part of the top surface of the machine shown in FIG. 1.

A control panel is provided on top of the copying machine 1, and, as shown in FIG. 2, indicator plates, switch control and displays are arranged on the control panel. On the control panel, there are provided five selection switches 12 through 16, each having a particular designation for size conversion from an original to a copy, e.g., "A3 to B4" or "A3 to A4," and another designation for orientation of a copy paper with respect to an original, i.e., "V" or "P." It will be briefly explained as to the two choices of the orientation. That is, orientation "V" implies than an original is placed with its lengthwise direction vertical to an end reference line defined in the station 2 or the plate 2*b*. On the other hand, orientation "P" denotes that an original is placed with its lengthwise direction parallel to the end reference line. Thus, if an original is postured in "V" orientation, use should be made of those selection switches with designation of "V" orientation. As will be easily understood, the designation of size conversion, e.g., "A3 to B4," implies that an original of A3 size will be reduced into a copy of B4 size. Five pilot lamps 17 through 21 are disposed next to the respective selection switches 12 through 16, and when one of the switches is selectively depressed by an operator, the corresponding pilot lamp will be lit to indicate that a particular selection has been made. Another switch 22 with a sign of "NORMAL" and a pilot lamp 23 corresponding thereto are also provided for the normal operation in which no size change takes place between an original and a copy. Thus, the magnification ratio of the switch 22 is unity.

Figure 3:
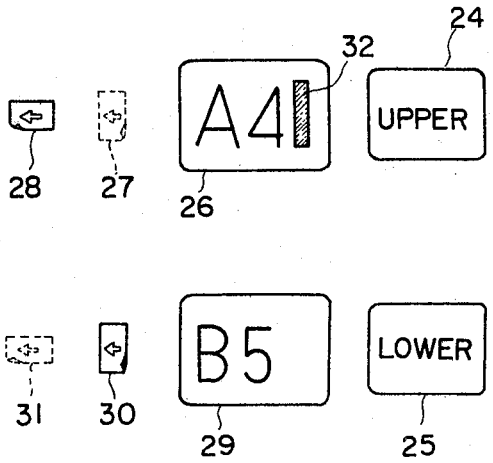
FIG. 3 shows a part of the control panel shown in FIG. 2 in a certain operating condition.

The control panel also includes a pair of switches 24 and 25 for choosing either of the upper and lower magazines 10 and 11. The switch 24 is for the upper magazine 10 and the switch 25 is for the lower magazine 11. A set of displays 26 through 28 are provided for the switch 24. So, the display 26 indicates the size of the copy papers stored in the upper magazine 10 and at the same time either of the displays 27 and 28 is lit to indicate whether the copy papers stored in the upper magazine 10 are in "V" state or "P" state. Similarly, another set of displays 29 through 31 are provided for the switch 25. Each of the displays 26 and 29 has a bar sign which is lit to indicate which of the two magazines 10 and 11 has been selected by depression of the corresponding switch 24 or 25. One example of the operating conditions of these switches 24 and 25 and displays 26 through 31 is shown in FIG. 3, from which one would easily understand that copy papers of A4 size are stored in the upper magazine in "V" posture and copy papers of B5 size are stored in the lower magazine in "P" posture. Furthermore, since a bar sign 32 is lit in the display 26, it will be easily understood that the switch 24 has been depressed to select the upper magazine 10. Preferably, the displays may be made of well-known liquid crystal displays.

It is to be noted that, as shown in FIG. 2, the control panel further includes a pair of indicator plates 33 and 34. The indicator plate 33 has a sign "SIZE" and the other indicator plate 34 has a sign "ORIENTATION." As will be described later, these signs are provided such that they are normally not easy to see, but they are illuminated if desired copy papers having correct size and orientation are not installed. Thus, if the copy papers installed in the machine 1 do not have the size required by selecting one of the selection switches 12 through 16, the size indicator plate 33 will be illuminated. On the other hand, if the installed copy papers do not have the required orientation, the orientation indicator plate 34 will be illuminated. In the event that the installed copy papers have neither a required size nor a required orientation, both of the indicator plates 33 and 34 will be illuminated. And, therefore, an operator can immediately recognize what is wrong and what has to be done next to make a desired copy without requiring careful considerations.

Figure 4:
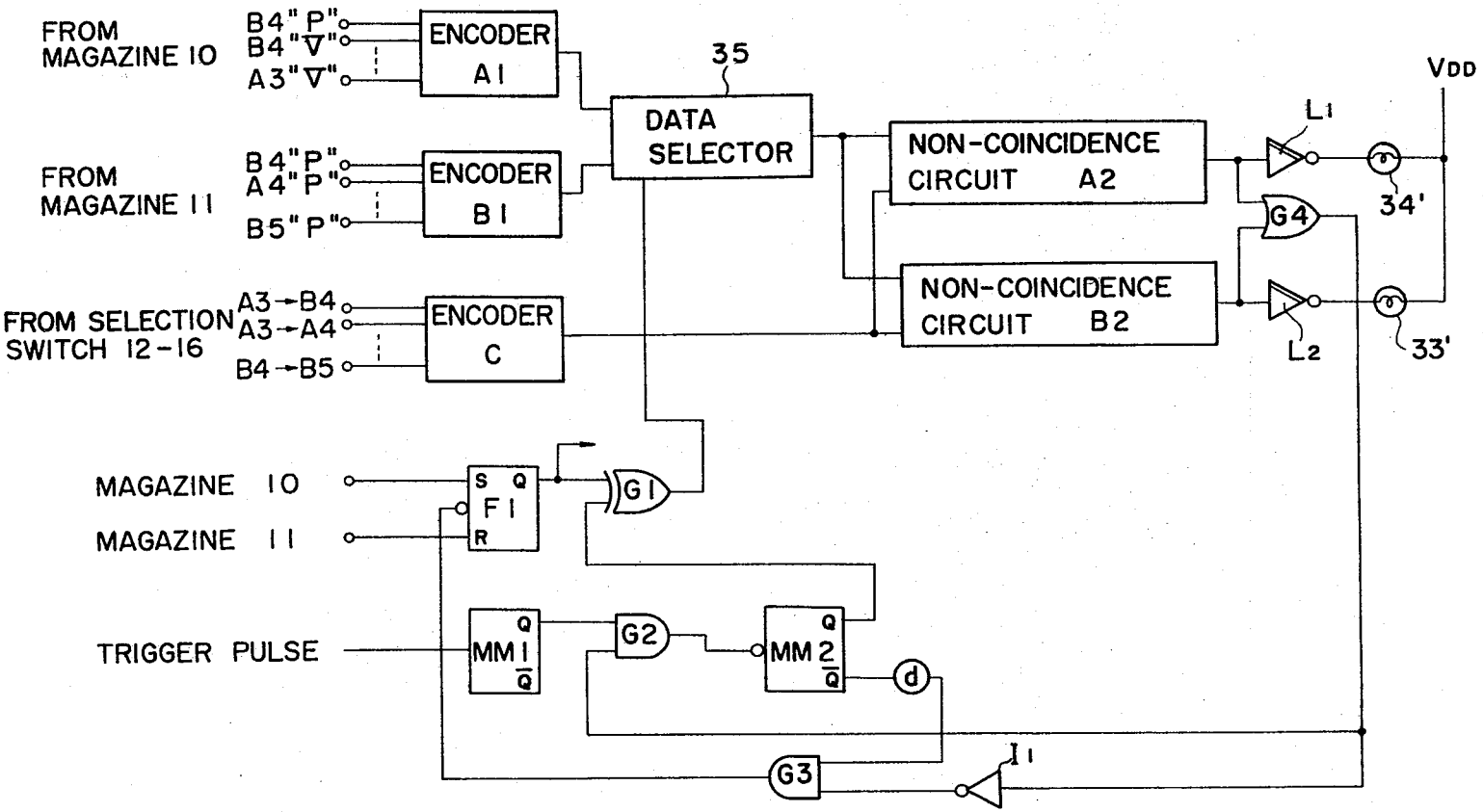
FIG. 4 is a circuit diagram partly in blocks illustrating one embodiment of the present invention.

Referring now to FIG. 4 which shows a circuit diagram in accordance with one embodiment of the present invention, there is provided a pair of encoders A1 and B1 which are connected to the upper magazine 10 and the lower magazine 11, respectively. Each of the encoders A1 and B1 receives information on size and orientation of the copy papers stored in the respective magazines and produces an eight bit code consisting of binary numbers as shown in FIG. 5. As will be easily understood from FIG. 5, only 5 bits are used in the present embodiment. Bits $b_0$ through $b_2$ and bit $b_4$ are used to identify the size of a copy paper with bit $b_4$ particularly used to identify size A or B. That is, the binary number 1 corresponds to size A and the binary number 0 corresponds to size B. Moreover, bit $b_5$ is used to identify the orientation of a copy paper with "1" denoting a vertical orientation and "0" a parallel orientation. Each code for a copy paper having a particular size and orientation is assigned a code designation as shown in the far right column of the table shown in FIG. 5.

Another encoder C is provided to receive information from the selection switches 12 through 16. Codes produced by the encoder C when the selection switches 12 through 16 are depressed are tabulated in FIG. 6, in which use is made of the same nomenclature as in FIG. 5. A data selector 35, such as a multiplexer, is connected to the encoders A1 and B1 to receive codes therefrom. The data selector 35 is also connected to the output side of an exclusive OR circuit G1 so that the data selector 35 permits to pass a code either from the encoder A1 or B1 in accordance with the output signal supplied from the exclusive OR circuit G1.

There is provided a pair of non-coincidence circuits A2 and B2, each of which has a pair of input terminals connected to the data selector 35 and the encoder C. The non-coincidence circuit A2 receives coded signals from the data selector 35 and the encoder C separately, and compares the states in bit $b_5$ to check whether they are identical or not. On the other hand, the non-coincidence circuit B2 also receives the signals from the data selector 35 and the encoder C to compare the states in bits $b_0$ through $b_2$ and $b_4$, thereby checking the presence of coincidence between the two signals. Either of the non-coincidence circuits A2 and B2 generates a high level output signal only when the two compared states, Hi or Lo, are not identical. Thus, if a discrepancy is found between the two compared states, one or both of inverters $L_1$ and $L_2$ and, therefore, associated indicator lamps 33' and 34' are turned on, thereby illuminating the related indicator plates 33 and 34. As is obvious for those skilled in the art, the non-coincidence circuits A2 and B2 may be formed by an exclusive OR circuit.

An OR gate G4 is connected between the output terminals of the non-coincidence circuits A2 and B2 with its output terminal connected to a driving circuit which is generally formed by a pair of mono-multivibrators MM1 and MM2 and a pair of AND gates G2 and G3. A flip-flop F1 is provided with its set terminal connected to the magazine 10, reset terminal to the magazine 11, and output terminal to one input terminal of the exclusive OR gate G1. The output of the flip-flop F1 is inverted when an inverting signal is fed from the AND gate G3. To the input terminal of the mono-multivibrator MM1 is supplied a trigger pulse which may be an independent pulse or clocking pulse.

Explanation will now be had with respect to the operation of the embodiment shown in FIG. 4 supposing that a quantity of copy papers of A4 size are stored in a vertical, or "V," posture in the upper magazine 10 and another quantity of copy papers of B5 size are stored in a parallel, or "P," posture in the lower magazine 11. Under the circumstances, the displays of the control panel will be indicated as shown in FIG. 3, and the encoders A1 and B1 will produce codes 34H and 05H, respectively, as easily understood from FIG. 5. Moreover, suppose that a selection switch 16 (A3 to B4) has been depressed so that it requires copy papers of B4 size in "V" posture and produces a coded signal of 24H as easily seen from FIG. 6.

Under the circumstances, when the switch 24 is depressed, the bar sign 32 is illuminated in the display 26 to indicate that the upper magazine 10 has been chosen as shown in FIG. 3. At the same time, the flip-flop F1 is set to generate a signal of the 1 state at the output terminal Q, which signal is then supplied to the date selector 35 through the exclusive OR gate G1, thereby allowing to pass the output signal from the encoder A1. As a result, the non-coincidence circuit A2 receives the coded signal 34H from the encoder A1 and the coded signal 24H from the encoder C, both of which signals are shown in FIG. 7 for comparison. As mentioned above, the non-coincidence circuit A2 compares the two states in bit $b_5$ in order to investigate the presence of orientation matching. In this particular instance, both of the coded signals have the state 1 in bit $b_5$ as best shown in FIG. 7, and, therefore, the output of the non-concidence circuit A2 remains at the 0 state, keeping the lamp 34' and the orientation indicator plate 34 off.

Figures 8, 9:
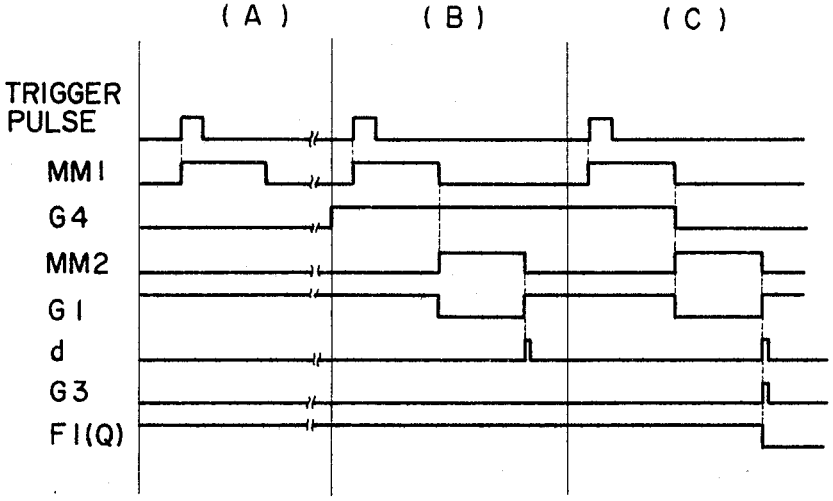
FIG. 8 is a chart showing several signals with high and low levels which would contribute to aid in understanding the operation of the circuit shown in FIG. 4.
FIG. 9 is a table showing two codes from encoders B1 and C to be compared at the non-coincidence circuits A2 and A3.

On the other hand, the two coded signals are also fed to the non-coincidence circuit B2 to see whether the sizes are matched. In this regard, as is obvious from FIG. 7, since there is a discrepancy in state in bit $b_4$, the non-coincidence circuit B2 generates an output signal of the 1 state, which, in turn, is supplied to the inverter $L_2$ to turn the lamp 33' and the size indicator plate 33 on. Furthermore, this output signal is applied to the AND gate G2 through the OR gate G4, which will contribute to trigger the mono-multivibrator MM2 when the output of the other mono-multivibrator goes to a low level, as shown in FIG. 8. Thus produced output from the mono-multivibrator MM2 is supplied to the exclusive OR gate G1 to change its output state into the 0 state, which, in turn, drives the data selector 35 to allow the coded signal from the encoder B1 to pass instead of the encoder A1.

As mentioned before, the lower magazine 11 contains copy papers of B5 size in "P" posture and in correspondence thereto the encoder B1 produces a coded signal of 05H. Thus, the non-coincidence circuits A2 and B2 each receive this coded signal of 05H and the coded signal of 24H from the encoder C as the selection switch 16 has been depressed. These two coded signals are shown in FIG. 9 for comparison.

At the non-coincidence circuit A2, the two states of these signals 05H and 24H in bit $b_5$ are compared to find a discrepancy as shown in FIG. 9; and, therefore, the state 1 signal is generated by the non-coincidence circuit A2 and is supplied to an inverter $I_1$ through the OR gate G4 to prevent the AND gate G3 from becoming operative, thereby avoiding an output from a differentiating circuit d, which is produced when the output of the mono-multivibrator MM2 changes from the 1 state to the 0 state, entering into the flip-flop F1. Accordingly, even when the mono-multivibrator MM2 returns to its original state, the flip-flop F1 remains set and the lamp 33' is kept turned on.

Now, suppose that the selection switch 13 (B4 to B5) has next been depressed. While the mono-multivibrator MM1 is in operation as triggered by the trigger pulse, each of the non-coincidence circuits A2 and B2 receives the coded signal of 34H from the encoder A1 through the data selector 35 and the coded signal of 05H from the encoder C as seen from FIG. 6. Since there is no correspondence in size as well as in orientation in this case, the mono-multivibrator MM2 becomes operative, which, in turn, drives the data selector 35 to switch connection from A1 to B1, thereby allowing the coded signal of 05H from the encoder B1 to pass onto the non-coincidence circuits A2 and B2. Therefore, now the encoders B1 and C come to supply the same coded signal of 05H to both of the non-coincidence circuits A2 and B2, which then produces the 0 state signals to turn the lamp 33' and 34' off to indicate that desired copy papers have been found. At the same time, the output of the OR gate G4 is turned to the 0 state to produce the 1 state signal at the output side of the inverter $I_1$. Thus, when a pulse is produced by the differentiating circuit d at the rising of the output at $\overline{Q}$ terminal at the termination of operation of the mono-multivibrator MM2, such a pulse is supplied to the flip-flop F1 through the AND gate G3 to change its state. In other words, the flip-flop F1, hitherto in the state of selecting the upper magazine 10, is now changed to the state of selecting the lower magazine 11.

It has so far been described as to the operation of the embodiment shown in FIG. 4 when the switches 13 and 16 are sequentially depressed under the condition that the upper magazine 10 contains therein copy papers of A4 size in "V" posture and the lower magazine 11 containes therein copy papers of B5 size in "P" posture. It should however be noted that similar operations will occur even if other selection switches are depressed or copy papers having other sizes and/or orientation are stored in the magazines. It should also be appreciated that in accordance with the present invention, if the first selected magazine did not contain desired copy papers, investigation automatically proceeds to the next magazine until desired copy papers have been found. If not found, it will be indicated what is lacking, size or orientation. If desired, it may be so structured that the lower magazine 11 store copy papers having the size and orientation which are most often used. In this case, since the size and orientation are fixed for the lower magazine 11, the displays 30 and 31 as shown in FIG. 2 may be removed.

FIG. 8 will contribute to understand the operation of the circuit shown in FIG. 4. In FIG. 8, part(A) is the case when correspondence is obtained in size as well as in orientation; part (B) is the case when correspondence is obtained neither in size nor in orientation; and part (C) is the case when correspondence is obtained in size and orientation after switching to the next magazine following the state of part (B).

Figure 10:
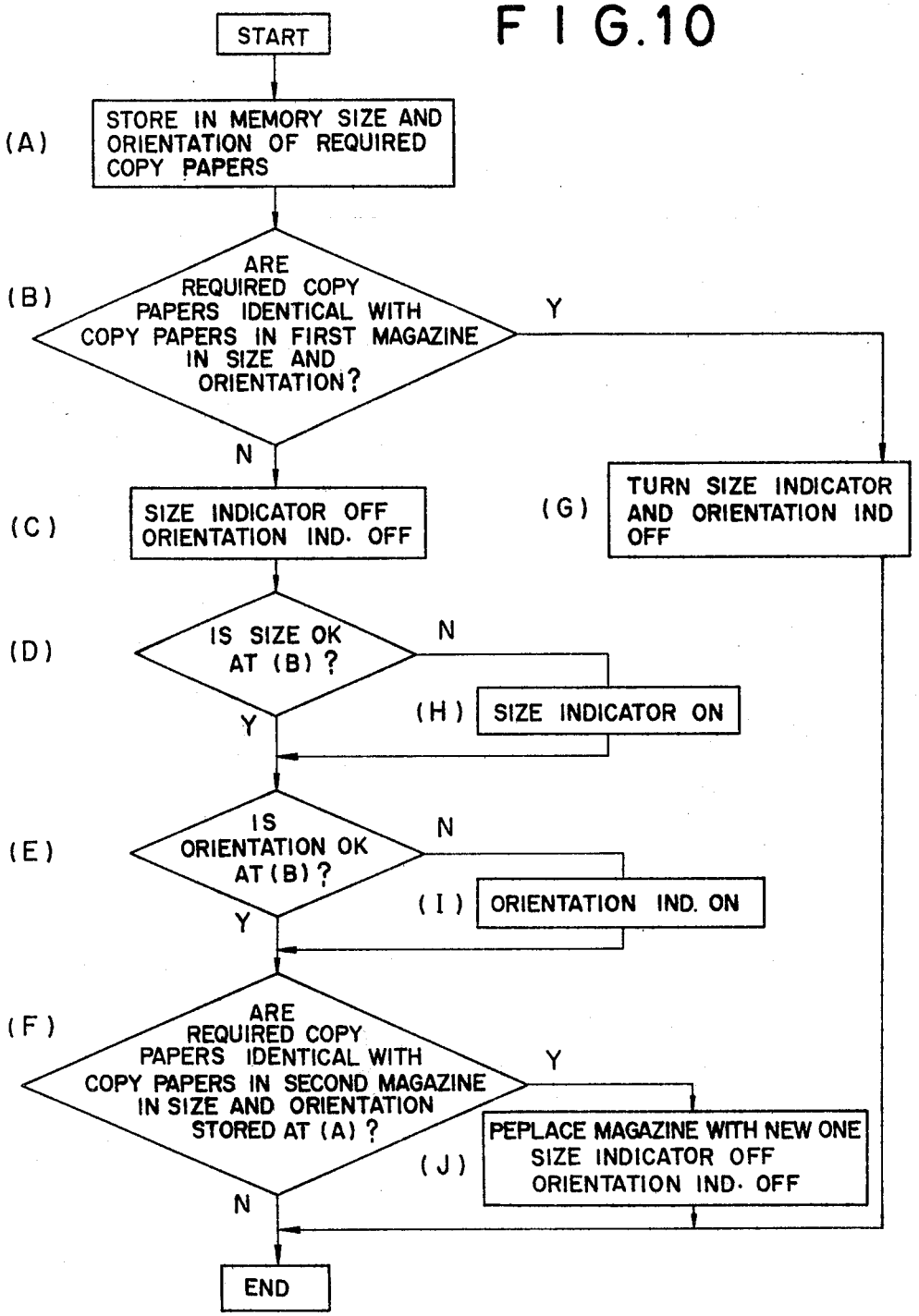
FIG. 10 is a flow chart generally illustrating the sequence of operation in accordance with the present invention.

FIG. 10 also shows the operation of one embodiment of the present invention in the form of a flow chart. The chart shows the flow of logics after selecting one of the selection switches 12 through 16.

As described above, since the present invention has made it possible to indicate whether size and/or orientation of the copy papers installed in a copying machine is inappropriate for a desired mode of reproduction operation, convenience in using the copying machine has been significantly improved.

While the above provides a full and complete disclosure of the preferred embodiment of the present invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A system for determining and indicating when the selected size and orientation of copy papers to be used in a copying machine are not proper, comprising:

storing means for storing a quantity of copy papers;

selection means for selecting a desired size and orientation of copy papers needed to be used;

comparing means for comparing the size and orientation of said stored copy papers with the size and orientation selected by said selection means;

a size indicator means for indicating any lack of correspondence between the size of said stored copy papers and the size selected by said selection means; and an orientation indicator means for indicating any lack of correspondence between the orientation of said stored copy papers and the orientation selected by said selection means.

2. The system as defined in claim 1 wherein said storing means includes at least two magazines for storing copy papers of at least two different sizes and/or orientations.

3. The system as defined in claim 2 further comprising switching means for producing a signal directing the copying machine to automatically switch from one magazine to another if the selected size and orientation are not obtained.

4. The system as defined in claim 3 wherein said switching means includes a data selector connected between said magazine and the input side of said comparing means, and a driving circuit connected between said data selector and the ouput side of said comparing means, whereby said data selector is driven by said driving circuit in accordance with an output signal from said comparing means to switch from one magazine to another.

5. The system as defined in claim 1 wherein said comparing means includes a first non-coincidence means for comparing the orientation of said stored copy papers with the orientation selected by said selection means to actuate said orientation indicator when not matched, and a second non-coincidence means for comparing the size of said stored copy papers with the size selected by said selection means to actuate said size indicator when not matched.

6. The system as defined in claim 5 wherein said first and second non-coincidence means are each comprised of an exclusive OR circuit.

7. The system as defined in claim 1 wherein said selection means includes a plurality of selection switches, each having a predetermined designation of size and orientation.

8. The system as defined in claim 7 wherein each of said selection switches indicates a particular magnification ratio between an original and a copy to be produced and each is assigned either a vertical orientation or horizontal orientation with respect to a frame of reference.

9. A copying machine for making copies from an original with various modification ratios comprising:

a photosensitive member;

forming means for forming a reproduced image on said photosensitive member;

storing means for storing a quantity of copy papers;

a plurality of selection switches for selecting a copy paper having a particular magnification ratio and orientation with respect to said original;

comparing means for comparing the size and orientation of said stored copy papers with the size and orientation of a copy paper selected by one of said plurality of selection switches;

a size indicator for indicating the lack of correspondence between the size of said stored copy papers and the size of said selected copy paper when actuated by said comparing means;

an orientation indicator for indicating the lack of correspondence between the orientation of said stored copy papers and the orientation of said selected copy paper when actuated by said comparing means; and feeding means for feeding said stored copy papers one by one if neither of said indicators are actuated to transfer said reproduced image on said photosensitive member onto the thus fed copy paper.

10. The copying machine as defined in claim 9 wherein said storing means includes at least two magazines for enabling to store copy papers of at least two different sizes and/or orientations.

11. The copying machine as defined in claim 10 wherein at least one of said magazines is detachably mounted in said machine.

12. The copying machine as defined in claim 10 further comprising switching means for producing a signal directing the copying machine to switch from one magazine to another if the required correspondence in size and orientation is not obtained.

13. The copying machine as defined in claim 12 wherein said switching means includes a data selector connected between said magazines through encoders and the input side of said comparing means, and a driving circuit connected between said data selector and the output side of said comparing means, whereby said data selector is driven by said driving circuit in accordance with an output signal from said comparing means to switch from one magazine to another.

14. The copying machine as defined in claim 9 wherein each of said indicators includes a lamp which is lit by a signal generated by said comparing means when the required correspondence is not obtained.

15. The copying machine as defined in claim 9 wherein said comparing means includes a first non-coincidence means for comparing the orientation of said stored copy papers with the orientation of said selected copying paper to actuate said orientation indicator when the required correspondence is not obtained, and a second non-coincidence means for comparing the size of said stored copy papers with the size of said selected copy paper to actuate said size indicator when the required correspondence is not obtained.

16. The copying machine as defined in claim 15 wherein said first and second non-coincidence means are each comprised of an exclusive OR circuit.

17. The copying machine as defined in claim 10 wherein said feeding means includes a feed roller disposed at the exit end of each of said magazines, said feed rollers each being adapted to be started to feed copy papers one by one from the related magazine when it is selected for operation.

* * * * *